United States Patent [19]

Bruce

[11] 3,934,804

[45] Jan. 27, 1976

[54] SUPPORT FOR MANNEQUIN HEADS

[75] Inventor: Donald G. Bruce, Antioch, Calif.

[73] Assignee: The Raymond Lee Organization, Inc., a part interest

[22] Filed: Jan. 8, 1975

[21] Appl. No.: 539,261

[52] U.S. Cl. ..... 248/229; 223/66; 248/226 A

[51] Int. Cl.[2] ..... A45D 44/14; A41H 5/00; A41G 3/00; A47F 5/00

[58] Field of Search ..... 248/229, 226 A, 316 B; 223/66; 403/132; 279/2 R

[56] References Cited

UNITED STATES PATENTS

| | | | |
|---|---|---|---|
| 3,089,717 | 5/1963 | Gair | 403/132 |
| 3,290,074 | 12/1966 | Korecky | 403/132 UX |
| 3,424,419 | 1/1969 | Siegel | 223/66 X |
| 3,448,957 | 6/1969 | Friedman | 223/66 X |
| 3,489,383 | 1/1970 | Anson | 223/66 X |
| 3,631,325 | 12/1971 | Wenz | 312/341 NR X |
| 3,866,494 | 2/1975 | Dotson | 279/2 R |

FOREIGN PATENTS OR APPLICATIONS

| | | | |
|---|---|---|---|
| 848,899 | 9/1960 | United Kingdom | 403/132 |

*Primary Examiner*—J. Franklin Foss

[57] ABSTRACT

Two pivotally secured jaws can be placed inside a bore in a mannequin head and pivoted away from each other by lock means to press tightly inside the bore, to detachably secure the head to the jaws. The jaws are supported by an upwardly extending rod, the lower end of the rod being attached to a sphere.

The upward and sideways motions of the sphere are constrained by a hollow enclosure in which the sphere is disposed, and the downward motion of the sphere is constrained by a wedge that extends upwardly into the enclosure from the top surface of a table near the table's edge. An adjustable clamp presses the enclosure downwardly towards the top surface of the table. As the clamp is tightened, the wedge presses ever more tightly against the sphere, wedging it tightly against the enclosure and preventing the sphere from moving therewithin.

3 Claims, 2 Drawing Figures

SUPPORT FOR MANNEQUIN HEADS

SUMMARY OF THE INVENTION

The invention is directed towards a device that will detachably secure a conventional mannequin head to a table in any one of a number of possible orientations. Mannequin heads conventionally have downwardly extending bores in which supporting devices may be disposed. In such U.S. Pat. Nos. as 3,448,957, 3,424,419, 3,501,847, 3,586,281, and 3,489,383 a generally conical member is pressed tightly into this bore. After such a mounting procedure, the head bore will deform and become progressively harder to secure to the member.

In the present invention, a pair of elongated jaws are pivotally secured to each other, and can be pivoted away from each other by lock means to tightly press against the sides of such a bore. Thus, deformation of the bore is held to a minimum, and the jaws need only be sufficiently expanded to the minimum degree needed to hold the head.

In a manner similar to that shown in the above-mentioned patents, this invention utilizes a ball and socket joint to support the jaws in the head and allow the head to be inclined in various orientations. However, in this invention a novel structure is utilized to prevent this joint from rotating once it has been set in position.

DETAILED DESCRIPTION OF PREFERRED EMBODIMENTS

Figure 1:
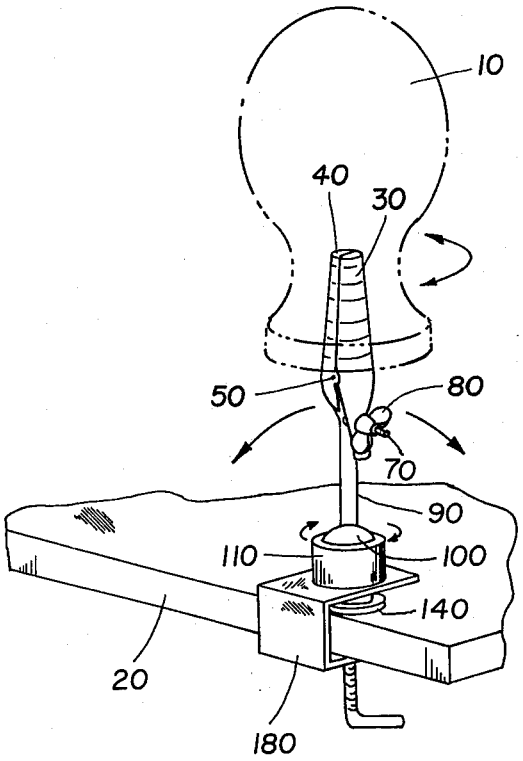
FIG. 1 shows the invention in use.

A conventional mannequin head 10 is detachably secured to a table 20 in any one of a plurality of orientations by the invention.

In this embodiment, two like elongated and opposed jaws 30 and 40 are placed into a downwardly extending bore in the head. Jaw 40 is fixed, and jaw 30 is pivotally attached thereto by pivot rod 50, which allows the jaws to pivot in a plane. The jaws are so shaped that when they are not pivoted apart, they form a truncated cone with parallel, circular, regularly spaced ridges 60. A lock means has a bolt 70 that extends through the bottoms of the jaws and is rigidly attached to jaw 40. By threading wing nut 80 in the lock means down on the bolt, the bottoms of the jaws are pressed more closely together, expanding the tops of the jaws to abut the sides of any bore in which they are disposed.

Jaw 40 is supported at the top of upwardly extending rod 90, the lower end of the rod being attached to plastic sphere 100. The sphere is embedded in the interior of a hollow enclosure to form a ball and socket joint. The enclosure has a hollow cylindrical body 110 with an annular lip 120 attached to its top, the interior radius of the lip being smaller than the radius of the sphere and thus preventing the sphere from poppong out the center of the annulus. It can be seen in FIG. 2 that the rod extends upwardly through the center of the lip, and thus can rotate anywhere within the solid angle formed by the inner circumference of the lip and the center of the sphere. The sphere is prevented from any translational movement by packing 130 that surrounds its sides inside the enclosure, leaving the sphere free only to rotate.

A flat-bottomed teflon wedge 140 has its bottom on the top surface of the table, and extends upwardly therefrom into the enclosure. The wedge takes the form of a truncated cone with a concave top surface having a radius of curvature equal to the radius of the sphere. A circular wire retaining ring 150 fits loosely between a horizontal circular groove 160 on the outside of the wedge and a corresponding groove 170 on the inside of the packing. The ring prevents the wedge from falling out of the enclosure when the wedge is not resting on anything, and still permits a small degree of relative motion between wedge and enclosure.

Figure 2:
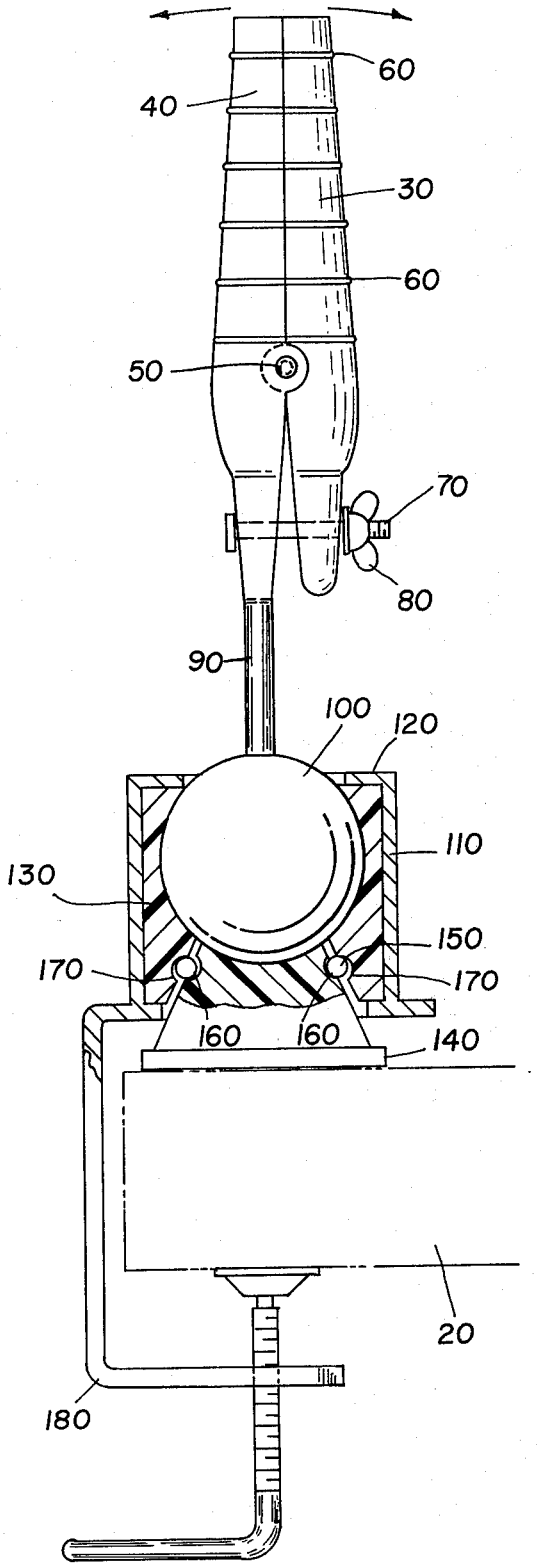
FIG. 2 is a cross-sectional side view of the invention.

An adjustable C-shaped clamp 180 is attached to the bottom of the body and extends around the edge of the table. As can be seen in FIG. 2, tightening the clamp forces the enclosure down, causing the wedge to wedge the sphere between the top surface of the wedge and the lip, thus preventing the rotation of the sphere.

What is claimed is:

1. A device for supporting a mannequin head and adapted to be secured to a table, said device comprising:

first and second upwardly extending elongated jaws pivotally secured together at a common point intermediate upper and lower ends of the jaws, the first jaw being fixed, the second jaw being pivotable in a vertical plane about the first jaw, both jaws having vertically spaced ridges which are aligned when the jaws are disposed together to define vertically spaced outer circular ridges, said jaws when disposed together defining a vertical truncated cone having said ridges on the outer surface;

a vertical rod secured at its upper end to the lower end of the first jaw and extending downward;

a sphere secured to the lower end of the rod;

a hollow enclosure with a horizontally disposed annular top lip of interior radius less than the radius of the sphere, the sphere being disposed inside the enclosure with the rod extending upward therefrom through the circular hole defined by the lip, said enclosure having an open region extending downward from the sphere to the bottom of the enclosure, said region having a peripheral horizontal circular groove;

a wedge shaped to fit into said open region and disposed therein, said wedge pressing upwards against the sphere, said wedge having an outer peripheral circular groove aligned with the groove in the region, said wedge being adapted to rest upon said table;

a circular ring fitting loosely within the aligned grooves to hold the wedge inside the enclosure;

an adjustable clamp adapted to engage the edge of the table and secured to the bottom of the enclosure leaving said open region exposed whereby said enclosure presses downward upon the wedge and said sphere is pressed against the lid and cannot rotate; and means extending through the lower ends of both jaws to lock same together in any desired pivot position.

2. The device of claim 1 further including a mannequin head having a downwardly disposed bore in which the upper portions of said jaws are disposed.

3. The device of claim 2 wherein said open region forms a vertical truncated cone with the base at the bottom and said wedge defines a truncated cone of like shape, the top of the wedge cone being concave with a radius of curvature equal to the radius of the sphere.

* * * * *